US007900739B2

(12) United States Patent
Bulgrien

(10) Patent No.: US 7,900,739 B2
(45) Date of Patent: Mar. 8, 2011

(54) CONTROL SYSTEM FOR A VEHICLE SYSTEM WITH A CONTINOUSLY VARIABLE TRANSMISSION

(75) Inventor: Garth H. Bulgrien, Ephrata, PA (US)

(73) Assignee: CNH America LLC, New Holland, PA (US)

( * ) Notice: Subject to any disclaimer, the term of this patent is extended or adjusted under 35 U.S.C. 154(b) by 898 days.

(21) Appl. No.: 11/609,723

(22) Filed: Dec. 12, 2006

(65) Prior Publication Data

US 2008/0140302 A1 Jun. 12, 2008

(51) Int. Cl.
*F02D 11/00* (2006.01)
*F02D 11/02* (2006.01)

(52) U.S. Cl. ..... 180/315; 180/335; 180/336; 180/364; 477/110; 701/93; 123/349; 123/358; 123/374; 192/3.62

(58) Field of Classification Search ..... 180/170, 180/178, 315, 335–338, 364; 477/43, 107, 477/110, 111; 123/349–356, 385, 363, 374; 701/93; 702/2, 93, 96, 115
See application file for complete search history.

(56) References Cited

U.S. PATENT DOCUMENTS

| | | | | | |
|---|---|---|---|---|---|
| 2,127,454 | A | | 8/1938 | Wolfe | |
| 2,728,072 | A | * | 12/1955 | Magid | 340/671 |
| 4,177,516 | A | | 12/1979 | Mason | |
| 4,279,324 | A | * | 7/1981 | Yotsumoto et al. | 180/336 |
| 4,566,415 | A | * | 1/1986 | Iwai et al. | 123/361 |
| 4,649,879 | A | | 3/1987 | Hofer | |
| 4,663,713 | A | | 5/1987 | Cornell | |
| 5,168,450 | A | * | 12/1992 | Ohkubo et al. | 701/114 |
| 5,231,965 | A | * | 8/1993 | Muzzy | 123/325 |
| 5,406,483 | A | * | 4/1995 | Kallis et al. | 701/53 |
| 5,417,193 | A | | 5/1995 | Fillman | |
| 5,803,043 | A | | 9/1998 | Bayron | |
| 5,863,057 | A | * | 1/1999 | Wessels | 280/149.2 |
| 5,979,582 | A | | 11/1999 | Hakansson | |
| 6,128,570 | A | * | 10/2000 | Akhteruzzaman | 701/93 |
| 6,138,069 | A | | 10/2000 | Ellertson | |
| 6,226,588 | B1 | * | 5/2001 | Teramura et al. | 701/93 |
| 6,247,378 | B1 | | 6/2001 | Newendorp | |
| 6,269,300 | B1 | | 7/2001 | Moore-McKee | |
| 6,289,873 | B1 | * | 9/2001 | Dunsworth | 123/352 |
| 6,470,771 | B2 | * | 10/2002 | Nanri et al. | 74/733.1 |
| 6,741,925 | B2 | | 5/2004 | Masters | |
| 6,819,996 | B2 | | 11/2004 | Graves | |
| 6,854,549 | B2 | | 2/2005 | Calamari | |
| 6,865,870 | B2 | | 3/2005 | Heisey | |
| 6,990,400 | B2 | | 1/2006 | Kilworth | |
| 7,085,645 | B2 | * | 8/2006 | Matsuda et al. | 701/110 |

(Continued)

*Primary Examiner* — Faye M. Fleming
*Assistant Examiner* — James English
(74) *Attorney, Agent, or Firm* — Patrick M. Sheldrake; Michael G. Harms

(57) ABSTRACT

The control system 10 of the first preferred embodiment includes a user interface 12 with a first control 14 that designates a maximum bound of a sub-range of engine speeds and a second control 16 that designates a minimum bound of a sub-range of engine speeds. The control system 10 of the first preferred embodiment also includes a processor 18 connected to the engine and to the user interface 12 that functions to, based on the required power output of the vehicle system, select a discrete engine speed from the sub-range of engine speeds. The control system 10 of the first preferred embodiment was designed for controlling engine speed of a vehicle system having an engine and a required power output, but may be used in any suitable environment.

8 Claims, 3 Drawing Sheets

U.S. PATENT DOCUMENTS

| | | | | |
|---|---|---|---|---|
| 7,287,620 | B2 * | 10/2007 | Thomas et al. | 180/305 |
| 7,288,047 | B1 * | 10/2007 | Hitt et al. | 477/107 |
| 2002/0013654 | A1 | 1/2002 | Masters | |
| 2002/0029913 | A1 * | 3/2002 | Ito et al. | 180/170 |
| 2003/0018423 | A1 | 1/2003 | Saller | |
| 2003/0212483 | A1 | 11/2003 | Folke | |
| 2003/0221885 | A1 | 12/2003 | Calamari | |
| 2004/0084237 | A1 | 5/2004 | Petrie, Jr. | |
| 2005/0149245 | A1 | 7/2005 | Kilworth | |
| 2005/0154524 | A1 | 7/2005 | Matsuda | |

* cited by examiner

CONTROL SYSTEM FOR A VEHICLE SYSTEM WITH A CONTINOUSLY VARIABLE TRANSMISSION

TECHNICAL FIELD

This invention applies to the field of vehicle control systems and, more specifically, to a control system for a vehicle with a continuously variable transmission.

BACKGROUND

Continuously variable transmissions (CVT) are becoming more commonly available in vehicles, including agricultural tractors. These transmissions, in combination with electronically controlled engines, provide the capability to smoothly change the transmission ratio and engine speed (revolutions per minute or RPM) to maintain or reach a desired power output and speed. In order to take full advantage of the CVT, conventional systems for the controlling engine speed include a variety of operator controls, which are fairly complex and confusing to many operators. A major contributor to this complexity is the control of the engine speed. An operator may wish to set the range of engine speed based on factors such as PTO operation, hydraulic requirements, the noise signature of the engine, and fuel economy.

Conventional systems for controlling engine speed of an agricultural tractor with a CVT typically include a hand throttle and a spring-loaded foot throttle to set the desired engine speed, and include additional switches or knobs to set operating modes. In some operating modes, the systems vary the engine speed within certain limits to minimize fuel consumption or to optimize other parameters. The amount of engine speed variation allowed and the proper usage of the modes are often not well understood by the operators. This can result in less-than-ideal operation of the agricultural tractor and may negate the advantages of the CVT.

Thus, there is a need in the vehicle control system field to create an improved control system for a vehicle with a continuously variable transmission. This invention provides such an improved control system.

DESCRIPTION OF THE PREFERRED EMBODIMENTS

Figure 1:
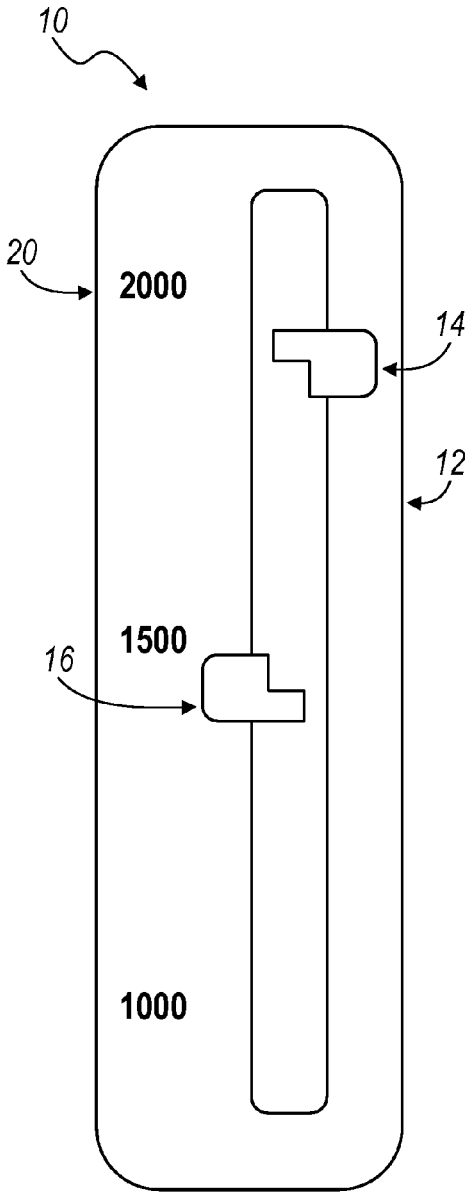
FIGS. 1, 2, and 3 are schematic drawings of the control system of the first preferred embodiment of the invention with a first variation of the first and second control.

The following description of the preferred embodiments of the invention is not intended to limit the invention to these preferred embodiments, but rather to enable any person skilled in the art to make and use this invention.

As shown in FIGS. 1-6, the control system 10 of the first preferred embodiment includes a user interface 12 with a first control 14 that designates a maximum bound of a sub-range of engine speeds and a second control 16 that designates a minimum bound of a sub-range of engine speeds. The control system 10 of the first preferred embodiment also includes a processor 18 connected to the engine and to the user interface 12 that functions to, based on the required power output of the vehicle system, select a discrete engine speed from the sub-range of engine speeds. The control system 10 of the first preferred embodiment was designed for controlling engine speed of a vehicle system having an engine and a required power output, but may be used in any suitable environment.

Figure 2:
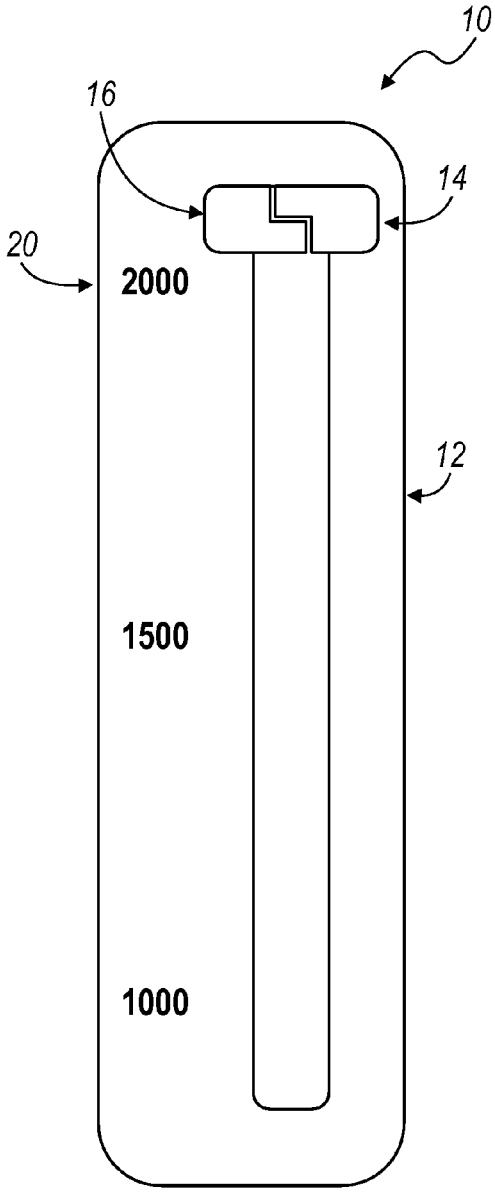
Figure 3:
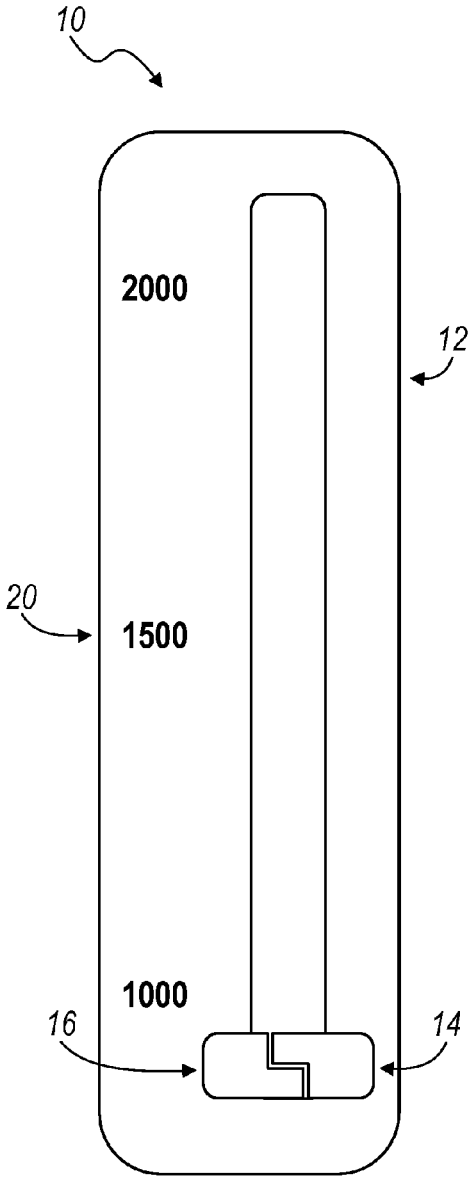

The user interface 12 functions to provide an interface for an operator to designate a maximum bound and a minimum bound of a sub-range of engine speeds for the engine. There are an endless number of sub-ranges of engine speeds that an operator may wish to designate. The sub-range of engine speeds allows the operator to base the speed of the engine on more than one parameter or function of the engine, such as power output, fuel efficiency, and noise signature. In a first example, as shown in FIG. 1, the operator may set the minimum bound of the sub-range at the engine speed that provides peak fuel efficiency, while setting the maximum bound of the sub-range at the engine speed that provides maximum power output. With this setting, the processor 18 will select an appropriate engine speed within this sub-range. In a second example, as shown in FIG. 2, the operator may set both the minimum and the maximum bounds of the sub-range at the engine speed that provides maximum power output. With this setting, the processor 18 will continuously select the engine speed that provides the maximum power output, regardless of the required power output. In a third example, as shown in FIG. 3, the operator may set both the minimum and the maximum bounds of the sub-range at the engine speed that idles the engine. With this setting, the processor 18 will continuously select the engine speed that idles, regardless of the required power output. By allowing the selection of a sub-range of engine speeds, the processor 18 can function to better match the intention of the operator and the required power output of the vehicle system.

The first control 14 of the first preferred embodiment functions to designate the maximum bound of a sub-range of engine speeds, while the second control 16 of the first preferred embodiment functions to designate a minimum bound of a sub-range of engine speeds. The first control 14 and the second control 16 are preferably made of plastic or metal, but may be alternatively made from any suitable, durable material. The first control 14 and the second control 16 may be rectangular, circular, or any other suitable geometry to properly interface with the operator. The controls may include a grip portion including geometry such as indents for fingers and a second material such as rubber to facilitate gripping or moving by hand or with fingers. The first control 14 and the second control 16 are preferably one of several variations.

In a first variation, as shown in FIGS. 1, 2, and 3, the first control 14 and the second control 16 are sliding controls that can be slid along a linear path in a track, groove, or in any other suitable device or manner. An operator may slide the first sliding control 12 to a point such that the first sliding control designates the maximum bound. Similarly, the operator may slide the second sliding control 14 to a point such that the second sliding control 14 designates the minimum bound. The first control 14 and the second control 16 may be located in the same track or groove, in separate tracks or grooves located near one another, in separate tracks or grooves located in different regions of the user interface, or in any other suitable configuration in any suitable region of the user interface. The first control 14 and the second control 16 preferably include an interlocking mechanism such that the maximum bound cannot be set below the minimum bound and the minimum bound cannot be set above the maximum bound. Preferably, the first control 14 has a portion that extends towards and mates with a portion of the second control 16 such that the first control 14 and the second control 16 can only slide on one side of each other. Alternatively, the interlocking mechanism may be located below the first control 14 and the second control 16 in the track or groove or in any other suitable location.

Figure 4:
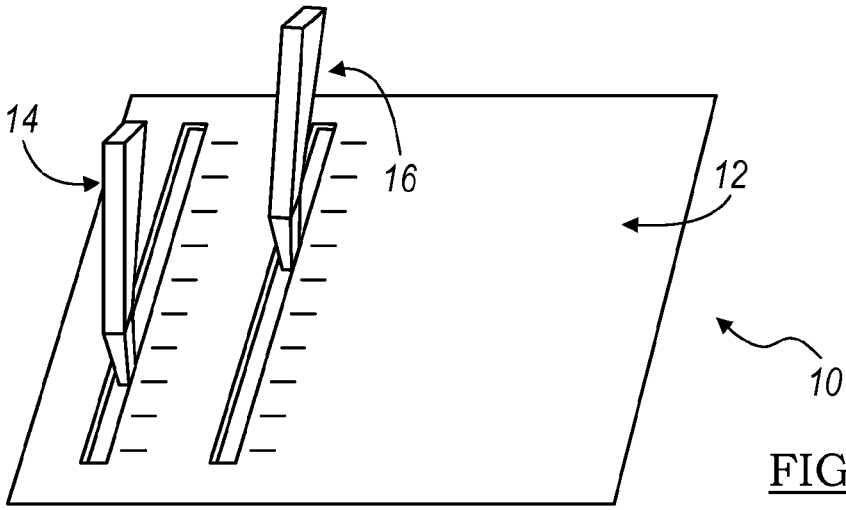
FIG. 4 is a schematic drawing of the control system of the first preferred embodiment of the invention with a second variation of the first and second control.

In a second variation, as shown in FIG. 4, the first control 14 and the second control 16 are levers that can be pivoted about an axis. In this variation, an operator may push, pull, pivot, or move the first control 14 to a point such that the first control designates the maximum bound. Similarly, the operator may push, pull, pivot, or move the second control 16 to a point such that the second control 16 designates the minimum bound. The first control 14 and the second control 16 may be located on the same pivot point, located near one another in the same region of the user interface, located in different regions of the user interface, or in any other suitable configuration in any suitable region of the user interface. The first control 14 and the second control 16 preferably include an interlocking mechanism such that the maximum bound cannot be set below the minimum bound and the minimum bound cannot be set above the maximum bound. The interlocking mechanism may be incorporated into the geometry of the first control 14 and the second control 16, or alternatively, the locking mechanism may be located below the first control 14 and the second control 16 at the pivot point in any other suitable location.

Figure 5:
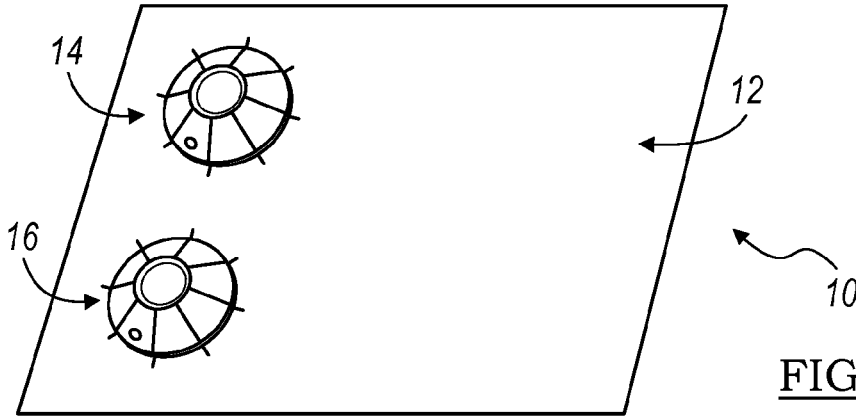
FIG. 5 is a schematic drawing of the control system of the first preferred embodiment of the invention with a third variation of the first and second control.
Figure 6:
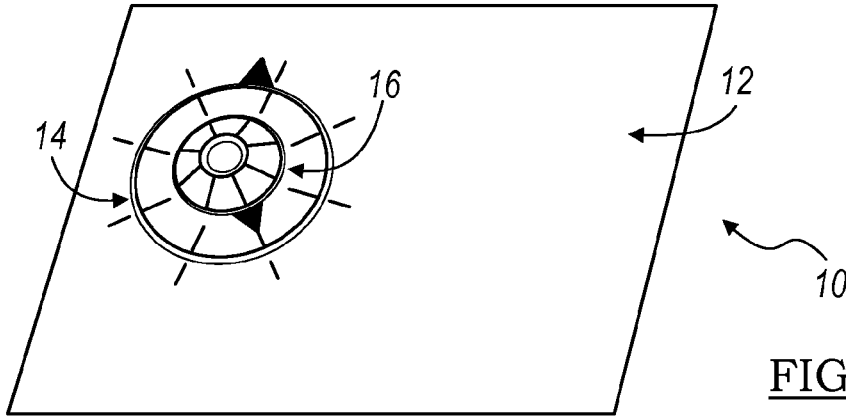
FIG. 6 is a schematic drawing of the control system of the first preferred embodiment of the invention with a fourth variation of the first and second control.

In a third and fourth variation, as shown in FIGS. 5 and 6, the first control 14 and the second control 16 are dials that can be rotated about an axis (that, unlike the lever of the second variation, preferably intersects the operator). An operator may turn or rotate the first control 14 to a point such that the first control 14 designates the maximum bound. Similarly, the operator may turn or rotate the second control 16 to a point such that the second control 16 designates the minimum bound. In this variation, the first control 14 and the second control 16 may include an arrow, a dot, a line, or any other suitable indicator on the dial, adjacent to the dial, or in both locations such that the operator may rotate the first control 14 and the second control 16 to a specific point to designate the maximum and minimum bound respectively. The first control 14 and the second control 16 may be located near one another in the same region of the user interface, located in different regions of the user interface, or in any other suitable configuration in any suitable region of the user interface (shown in FIG. 5). In the fourth variation (shown in FIG. 6), the first control 14 and the second control 16 are dials and the first control 14 and the second control 16 are concentrically located and rotate about the same axis. The first control 14 and the second control 16 are preferably standard dials and may be circular, polygonal (hexagonal, octagonal, etc.), rectangular or any other suitable geometry such that the operator may turn or rotate them. The first control 14 and the second control 16 preferably include an interlocking mechanism such that the first control 14 cannot rotate beyond a certain point and designate the maximum bound below the minimum bound and the second control 16 cannot rotate beyond the first control 14 and designate the minimum bound above the maximum bound. The interlocking mechanism may be incorporated into the geometry of the first control 14 and the second control 16. Preferably, the first control 14 has a portion that extends towards and mates with a portion of the second control 16 such that the first control cannot rotate beyond the second control and vice versa. As in the fourth variation, where the dials are located concentrically, the dials may fit into one another such that the first control 14 cannot rotate beyond the second control 16 and vice versa. Alternatively, the locking mechanism may be located below the first control 14 and the second control 16 or in any other suitable location.

Although the first control 14 and the second control 16 are preferably one of these four variations, the first control 14 and the second control 16 may be any suitable device such that the first control 14 designates the maximum bound and the second control 16 designates the minimum bound of a sub-range of engine speeds.

As shown in FIGS. 1, 2, and 3, the control system 10 may further include indicia 20. The indicia 20 of the first preferred embodiment function to identify the engine speeds that the first control 14 and the second control 16 may designate as the maximum bound and the minimum bound respectively. The indicia 20 are preferably one of several variations. In a first variation, the indicia 20 are one or more numerical values (in RPM units or any other suitable units), symbols (such as a tortoise and hare or any other suitable symbols), or colors that correspond to engine speeds. In a second variation, the indicia 20 are one or more words or symbols that correspond to a parameter or function of the engine, such as power output, fuel efficiency, and noise signature. The indicia 20 are preferably engravings, labels attached with durable adhesive, or markings molded into the user interface, the first control 14, and/or the second control 16. Alternatively, the indicia 20 may be any other suitable markings on the control system 10, first control 14, and/or second control 16 in any other suitable manner. Although the indicia 20 are preferably one of these two variations and any combination of these two variations, the indicia 20 may be any suitable markings to identify the engine speeds that the first control 14 and the second control 16 may designate as the maximum bound and the minimum bound respectively.

The processor 18 of the first preferred embodiment is connected to the user interface and to the engine and functions to select a discrete engine speed from the sub-range of engine speeds selected by the operator. The processor 18 preferably selects the discrete speed based on the required power output of the vehicle system. The processor 18 may further select the discrete speed based on the noise signature of the engine and/or fuel efficiency of the engine. The processor 18 is preferably a conventional processor but may alternatively be any suitable device to perform the desired functions.

Figure 7:
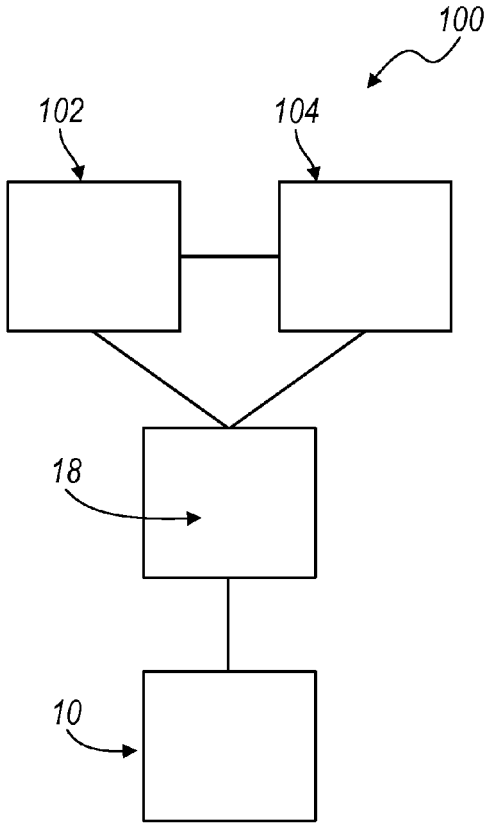
FIG. 7 is a schematic drawing of the vehicle system of the second preferred embodiment of the invention.

As shown in FIG. 7, the vehicle system 100 of the second preferred embodiment includes an engine 102, a continuously variable transmission 104 connected to the engine that functions to deliver the power output from the engine to the vehicle system and to deliver a range of output speeds to the vehicle system, and the control system 10 of the first preferred embodiment.

The engine 102 of the second preferred embodiment functions to power the vehicle system. The engine 102 is preferably an internal combustion engine, but may alternatively be any suitable engine or power source. The engine 102 preferably operates within a range of engine speeds and provides a power output in the form of rotational motion at a given angular velocity. Within the range of engine speeds, the engine 102 preferably has a peak engine efficiency speed and a peak engine power speed.

The continuously variable transmission (CVT) 104 of the second preferred embodiment functions to allow the engine to operate within the range of engine speeds while delivering the power output from the engine and a wide range of output speeds to the vehicle system. The CVT 104 functions to change the speed ratio between the engine and the vehicle system. The CVT 104 preferably allows continuous variability between the highest and lowest ratios of engine speed to output speed, but may alternatively function in multiple discrete steps or shifts (preferably more than 12) between ratios. The CVT 104 is preferably the CVT that is described in U.S. Pat. No. 6,913,555 issued on 05 Jul. 2005 and entitled "CVT Transmission for Motor Vehicles, in Particular for Agricultural Tractors", which is incorporated in its entirety by this reference, but may be any suitable transmission that changes the speed ratio between the engine and the vehicle system.

Although omitted for conciseness, the preferred embodiment include every combination and permutation of the various control systems 10, user interfaces 12, first controls 14, second controls 16, processors 18, indicia 20, vehicle systems 100, engines 102, and continuously variable transmissions 104.

As a person skilled in the art will recognize from the previous detailed description and from the figures and claims, modifications and changes can be made to the preferred embodiments of the invention without departing from the scope of this invention defined in the following claims.

I claim:

1. A control system for controlling engine speed of a vehicle system having an engine and a required power output, the control system comprising:

a user interface including a first adjustable control configured for selecting a maximum bound of a sub-range of engine speeds from a plurality of engine speeds and a second separately adjustable control configured for separately selecting a minimum bound of the sub-range of engine speeds from the plurality of engine speeds; and a processor coupled to the engine and to the user interface and adapted to, based on the required power output of the vehicle system, select a discrete engine speed from the sub-range of engine speeds;

the first and second controls configured for movement within a range of positions both in first and second linear directions corresponding to operable engine speeds of the vehicle, wherein the first control and the control are independently movable such that the first control designates the maximum bound an the second sliding control designates the minimum bound; and the first control and the second control further include an interlocking mechanism wherein at least one of the first or second controls extends into the linear path of the other control such that the maximum bound control cannot be moved to a position below the minimum bound control and the minimum bound control cannot be moved to a position above the maximum bound control.

2. The control system of claim 1 wherein the first control is colocated with the second control.

3. The control system of claim 1 wherein the engine further has a noise signature, wherein the processor is adapted to select a discrete engine speed from the sub-range of engine speeds additionally based on at least one of the following factors: the noise signature of the engine, the power output of the engine, and the fuel efficiency of the engine.

4. A power system for a vehicle having a required power output and a speed, the power system comprising:

an engine with a power output that operates within a range of engine speeds;

a continuously variable transmission coupled to the engine, adapted to deliver the power output from the engine and to deliver a range of output speeds to the vehicle system;

a user interface including a first adjustable control configured for selecting a maximum bound of a sub-range of engine speeds from a plurality of engine speeds and a second adjustable control configured for separately selecting a minimum bound of the sub-range of engine speeds from the plurality of engine speeds; and a processor coupled to the engine and to the user interface and adapted to, based on the required power output and the required output speed of the vehicle system, select a discrete engine speed from the sub-range of engine speeds;

the first and second controls configured for movement within a range of positions both in first and second linear directions corresponding to operable engine speeds of the vehicle, wherein the first control and the control are independently movable such that the first control designates the maximum bound and the second sliding control designates the minimum bound; and at least one of the first or second controls having an interlocking mechanism that extends into the linear path of the other control such that the maximum bound control cannot be moved to a position below the minimum bound control and the minimum bound control cannot be moved to a position above the maximum bound control.

5. The power system of claim 4 wherein the first control includes a first sliding control and the second control includes a second sliding control, wherein the first sliding control and the second sliding control are adapted to be slid such that the first sliding control designates the maximum bound and the second sliding control designates the minimum bound.

6. The power system of claim 4 wherein the first control is colocated with the second control. first or second controls extends into the path of the other control such that the maximum bound control cannot be moved to a position below the minimum bound control and the minimum bound control cannot be moved to a position above the maximum bound control.

7. The power system of claim 4 wherein the first control designates the maximum bound to the maximum value of the range of engine speeds and the second control that designates the minimum bound to the maximum value of the range of engine speeds, wherein the processor selects the discrete engine speed of the maximum value of the range of engine speeds, such that the engine provides a maximum power output.

8. The power system of claim 4 wherein the first control designates the maximum bound to the minimum value of the range of engine speeds and the second control that designates the minimum bound to the minimum value of the range of engine speeds, wherein the processor selects the discrete engine speed of the minimum value of the range of engine speeds, such that the engine provides maximum fuel efficiency.

* * * * *